US006260867B1

(12) United States Patent
Yang et al.

(10) Patent No.: US 6,260,867 B1
(45) Date of Patent: Jul. 17, 2001

(54) CHILD WALKER

(75) Inventors: Cheng-Fan Yang, Tainan Hsien; Kuang-Neng Cheng, Chia-I Hsien, both of (TW)

(73) Assignee: Link Treasure Limited (VG)

( * ) Notice: Subject to any disclaimer, the term of this patent is extended or adjusted under 35 U.S.C. 154(b) by 0 days.

(21) Appl. No.: 09/348,384

(22) Filed: Jul. 7, 1999

(51) Int. Cl.[7] ..... B62B 7/00

(52) U.S. Cl. ..... 280/87.051; 280/650; 280/647; 280/33.994; 188/20

(58) Field of Search ..... 280/87.051, 47.38, 280/755, 650, 647, 657, 658, 33.992, 33.994; 188/1.12, 20, 82.1, 19, 5, 72.9

(56) References Cited

U.S. PATENT DOCUMENTS 5,785,154 * 7/1998 Chen ..... 188/1.12
5,813,681 * 8/1998 Saint et al. ..... 280/87.051
5,865,451 * 2/1999 Hu ..... 280/87.051
5,881,846 * 3/1999 French et al. ..... 188/1.12
5,888,178 * 3/1999 Welsh, Jr. ..... 280/755
5,899,471 * 5/1999 Li-Wei ..... 280/87.051
5,967,535 * 10/1999 King ..... 280/47.38

* cited by examiner

*Primary Examiner*—Michael Mar
*Assistant Examiner*—Hau Phan
(74) *Attorney, Agent, or Firm*—W. Wayne Liauh

(57) ABSTRACT

The present invention relates to a child walker, which utilizes a circular base member and a specially designed moving device to provide the functions of tipping preventing and auto-braking. By these designs, the child walker can prevent from tipping when it passes over an edge of a floor or vicinity of stair steps and control the speed of the child walker. The moving device is connected to the bottom of the circular base member for supporting the circular base member, wherein the moving device further comprises un-directional rollers for moving to an uncertain direction, directional rollers for moving to a certain direction but with a little deviation in angle from the forward direction and a stopping means for prevent the child walker from tipping when any roller is passing over an edge of a floor and then inclining by the friction between the bottom of the circular base member and the surface of the floor.

8 Claims, 10 Drawing Sheets

CHILD WALKER

FIELD OF THE INVENTION

The present invention relates to a child walker, and more particularly to a child walker with a capability of bearing a child in a seated position, a capability of supporting a child in standing position, a capability of assisting a child in learning walking and a capability of preventing from tipping.

BACKGROUND OF THE INVENTION

In the growth of children, child walkers provide a convenient means for an infant to be entertained, before, during, and after the transition from crawling to walking. Walkers provide support for a child in a seated position, but are readily movable by the child in a standing position. In the early learning, children have not the ability of controlling the direction of moving of walkers, which may go in the direction of uncertain manner, sometimes forward, sometimes backward, sometimes left, sometimes right. It is obvious that children can not choose the direction toward the dangerous area or toward the safe area under the situations described as foregoing.

Conventional walkers typically include a seat chair which is connected to the circular frame by supporting structure for supporting the child and some wheels located in the bottom of the circular frame. The number of wheels is not certain, it may be four wheels located at four corners of the frame or, more, six wheels. Conventional walkers can be freely oriented toward any directions through all non-directional wheels without constrains or brake arrangement. But it is very dangerous for children who are not able to control the direction of walkers yet. Accordingly, conventional walkers are generally provided with instructions and warnings to advise against the use of the walker without appropriate caregiver supervision, or against the use in the vicinity of floor edges, such as stair steps. However, these instructions and warnings, although practical and effective when followed, are not always observed. Therefore some terrible tipping accidents of the child walker occurred, especially when the child walker passes over an edge of a floor or the vicinity of stair steps.

An example of a conventional walker which attempts to respond to these concerns may be found in U.S. Pat. No. 5,813,681 ("the '681 patent") to Graco Children's Products Inc., issued Apr. 17, 1996. The '681 patent is to provide a child walker which has improved stability and resistance to tipping by including three wheels located in the relative position of triangle, in which two wheels are freely oriented and one wheel is constrained to move in a straight line to limit the direction of travel allowed by the child to maximize its stability. The '681 patent is to provide a child walker with immediate braking when the walker passes over an edge or a ledge. Besides, the '681 patent provides a child walker which can be adjusted by a caregiver to control the speed of the walker, and provides a rolling mechanism adapted for connection to a base member of a child walker to provide immediate braking or to limit the direction of travel of the child walker when the mechanism proceeds over an edge or a ledge.

SUMMARY OF THE INVENTION

The present invention is to provide a child walker which is safe and can prevent from tipping , especially, when it passes over an edge of a floor or the vicinity of stair steps.

Another object of the present invention is to provide a child walker that has an auto-brake structure and can restrict the moving speed.

The present invention child walker includes a seat for supporting a child, a supporting structure connected to the circular base member for supporting the seat and moving device which is located at the bottom of the base member in an appropriate position separately for supporting the base member and can be freely moved. The circular base member and the specially designed moving device prevent the child walker from tipping when it passes over an edge of floor or the vicinity of stair steps and provide an auto-braking function to restrict the moving speed of child walker.

The present invention, child walker, includes the following functions.

Firstly, the function of resistance to tipping, which is achieved by a specially designed moving device which constrains the child walker to move in only desired narrow directions in order to prevent the lateral movement of the child walker, especially when the child walker is passing over an edge of floor or the vicinity of stair steps, and when the center of gravity of the child walker is getting close to, but not getting over, the edge of the floor or the vicinity of stair steps , the child walker is then sloping, and by the bottom area of the circular base member or by the friction pad attached to the bottom area of the circular base member in order to provide sufficient friction force between the child walker and the floor and to prevent the child walker from continuing moving.

The function of auto-braking and control of the moving speed of moving of the child walker, which is provided by the specially designed moving device, which can effectively constrain the child walker toward a desired narrow direction. When the child walker encounters a lateral force or external force to push it toward the side direction, the moving device will automatically generate a counter force to make the child walker slow down and in the same time keep the direction of the child walker toward the desired direction considered safe in order to secure the child walker not to tip in case of passing over the edge of the floor or vicinity of the stair steps.

The moving device of the present invention of chid walker includes a circular base member, two un-directional rollers and two directional rollers. These rollers are respectively connected to four corners of the circular base member of the child walker, wherein the un-directional rollers can turn around to any direction and move to the desired direction while the directional rollers are constrained to only one direction but with a little deviation from the predetermined direction. That is, the directional rollers will automatically provide a braking force to prevent the child walker from over speeding or lateral moving when the child walker does not go to the safe moving direction.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Embodiments of the present invention will now be described with reference to the drawings. In view of the fact that the design of components of the embodiments can be modified as needed using the techniques which are apparent to persons with ordinary skill in the art at the time of filing the basic application, the invention should not be considered to be limited to the details of the embodiments given herein.

Figure 1:
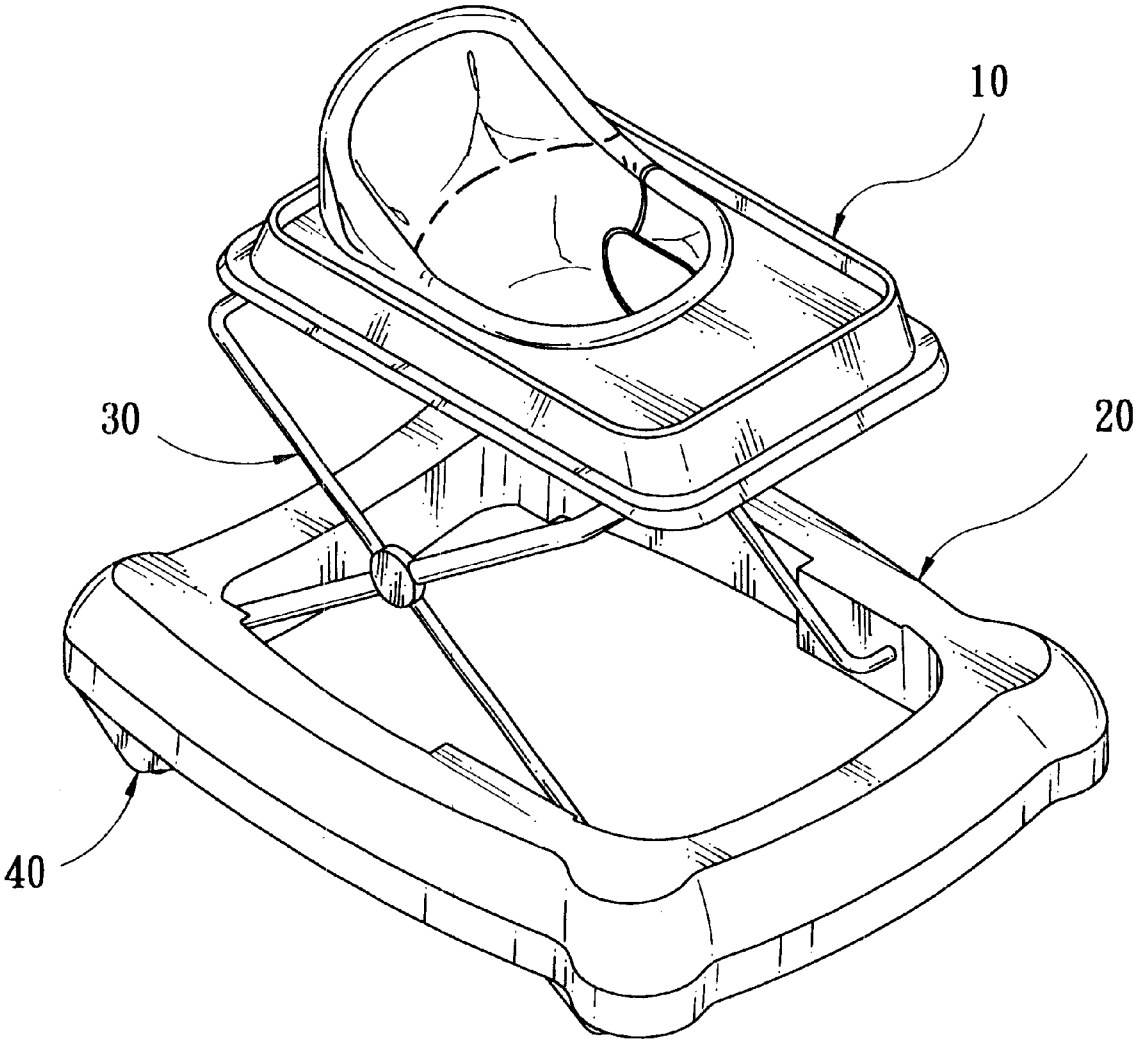
FIG. 1 is a perspective view of an embodiment of the present invention, the child walker.

FIG. 1 shows a preferred embodiment of a child walker in accordance with the present invention. The child walker generally comprises a seat 10, a supporting structure 30 and a moving device 40. The seat 10 is used for supporting the body of the child, and the supporting structure 30 is connected to the circular base member 20 for supporting the seat 10 and the moving device 40. The moving device is located at the bottom of the base member 20 in an appropriate position separately for supporting the base member 20 and can be freely moved. In addition, the moving device 40 is composed of several roller elements which can freely turn and are arranged equally at the bottom of the base member 20 for supporting the base member 20 and making the child walker keeping a balanced status on the floor. These roller elements are un-directional rollers 50*a* and 50*b* which are connected to the front corners of the circular base member 20, and directional rollers 60*a* and 60*b* which are connected to the rear corners of the circular base member 20, see FIG. 3. The un-directional rollers 50*a* and 50*b* can turn freely toward the uncertain direction while the directional rollers 60*a* and 60*b* are constrained to one direction but with some degrees of deviation in angle. The circular base member 20 is preferred to be in a shape of rectangle with two sides longer, and the forward direction is in accordance with the direction of the long side.

Figure 2:
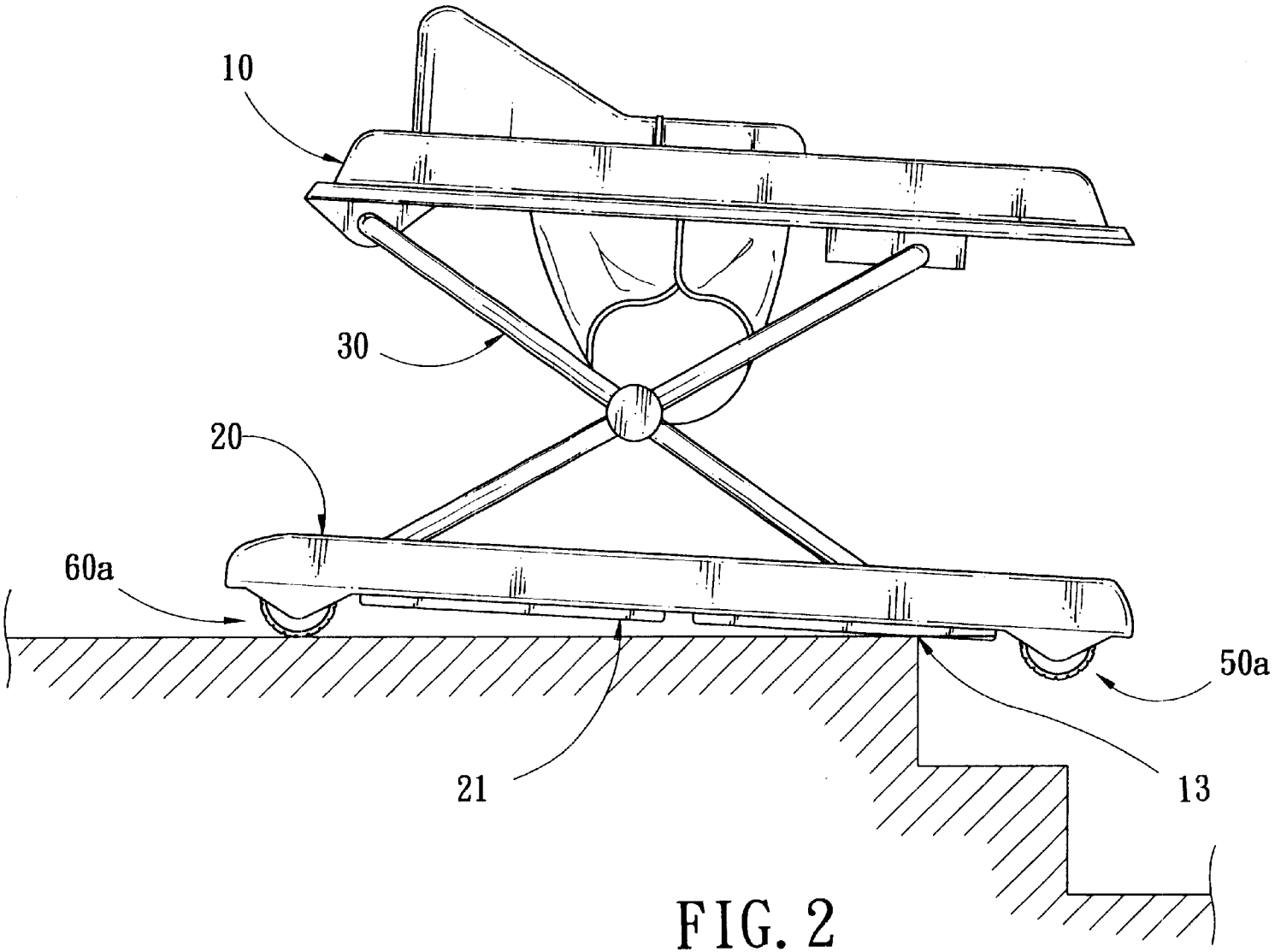
FIG. 2 is a side view of an embodiment of the present invention, the child walker, depicting the status that the child walker is passing over the edge of floor or vicinity of the stair steps and utilizes the bottom of the base member to stop the moving of the child walker.
Figure 3:
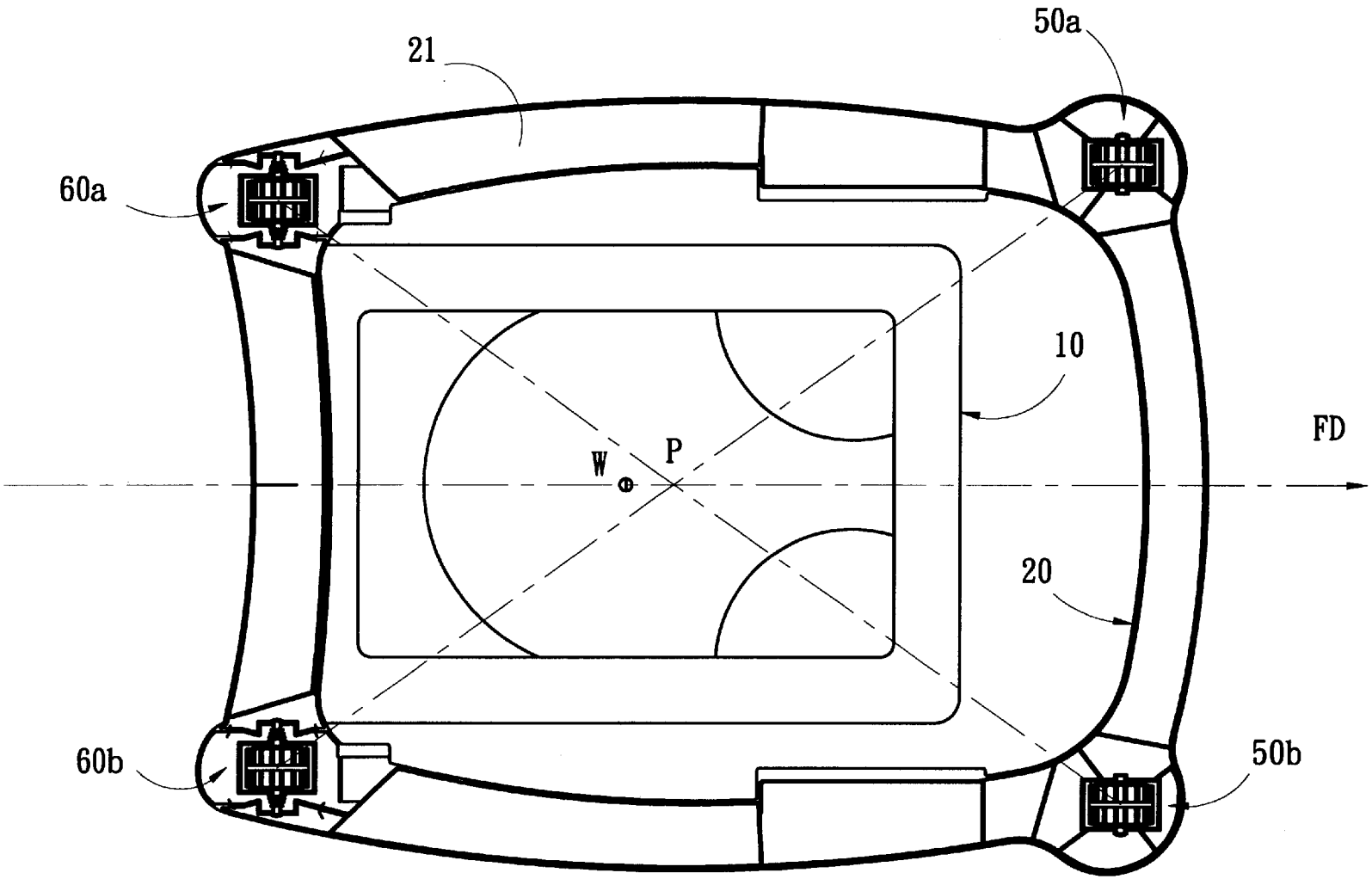
FIG. 3 is a bottom view of an embodiment of the present invention, the child walker, depicting the arrangement of the moving devices connecting to the bottom of the base member for stopping the moving of the child walker.

Referring now to FIG. 2 and FIG. 3, the embodiment of the present invention can prevent from tipping when the walker is passing over the edge B of the floor or vicinity of the stair steps. By assuming that the child walker is generally moving forward, the preferred design is to locate the center of gravity of the whole body of a child at the point W which is a little near the rear end, as shown in the FIG. 3. The location of W is preferred to be at the point that is a little behind the intersection P of the connecting lines of roller devices 50*a*, 50*b*, 60*a* and 60*bh* and near the base member 20.

Under this design, the child walker can further prevent from tipping when the child walker is passing over the edge B of the floor or stair steps, but the center of gravity of the child walker is kept behind the edge B. This is the reason why the child walker is safer when it is moving forward under general usage. With the circular base member 20 and the specially designed moving device 40 of the present invention, when the child walker passes over an edge B of the floor surface or stair steps but keep its center of gravity not to pass over the edge B, the child walker slopes toward the direction of moving of the undirectional roller devices 50*a* and 50*b* which are now hanging in the air and break the equilibrium of the base member 20, but can be immediately stopped further tipping and moving forward because of the friction force between the bottom of base member 20 of the child walker and the floor surface. In order to increase the friction force between the bottom of base member 20 and the floor surface, a friction strip 21 is connected to the bottom of the base member 20. A rubber made friction strip 21, a friction strip 21 with roughened surface and a friction strip with zigzag surface are effective examples to meet the demands above.

Figure 10:
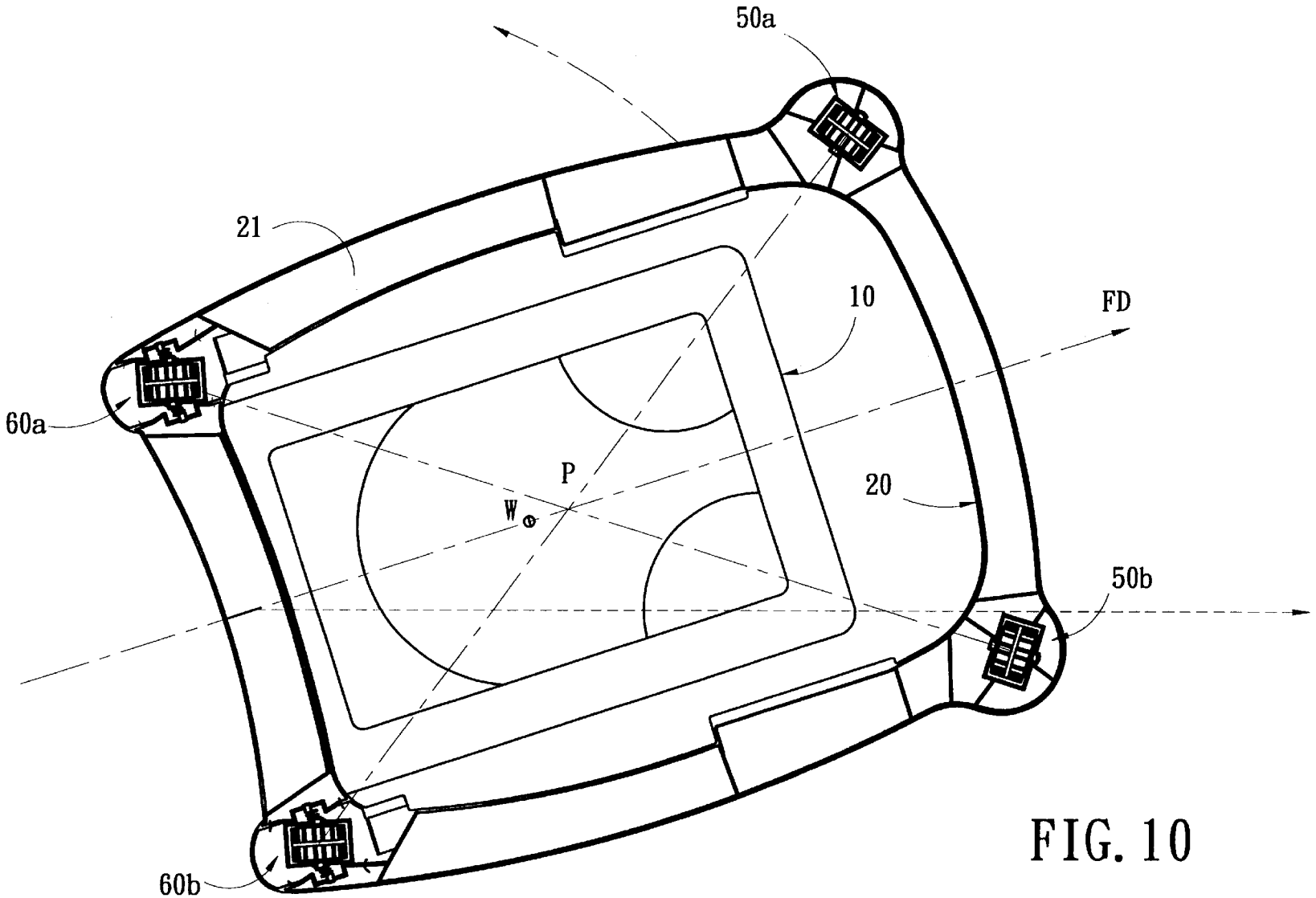
FIG. 10 is an operational diagram of FIG. 3, which shows that the child walker is moving to the safe direction by self-adjusting when it is encountering a lateral force.

As shown in FIG. 10, in the conditions of practical operation it is not easy for a child who is beginning to learn walking to operate the child walker just going forward in a straight line. Under the conditions that the center of gravity W of the child walker does not exceed the edge B, the child walker is actually constrained to the forward direction with a little deviation in angle, that is, the child walker is going in the direction considered safe to some extent.

In the real circumstances of operation, the reasons why child walker can not go forward in the safe direction described as above are that the child walker encounters an external force or that the child can not effectively control the direction of the child walker. When these conditions come up, we can use the directional rollers 60*a* and 60*b* connected to the rear of the circular base member 20 to solve the problem. A preferred design of the directional rollers 60*a* and 60*b* is to provide an ability of braking or slowing down when necessary. When the rear directional rollers 60*a* and 60*b* are blocked, the child walker will firstly turn around in the same place, as shown in FIG. 10 by an arc arrow, by centering around one of the directional rollers 60*a* and 60*b*, and then adjust gradually the direction by itself toward the safe direction described as above.

The first embodiment of the moving device, as shown in FIG. 3, includes four equally distributed turning devices connected to the four corners of the bottom of the circular base member 20. Two of them are the un-directional rollers 50*a* and 50*b* connected to the front of the circular base member 20, and the others are the directional rollers 60*a* and 60*b* connected to the rear of the circular base member 20.

Figure 4A:
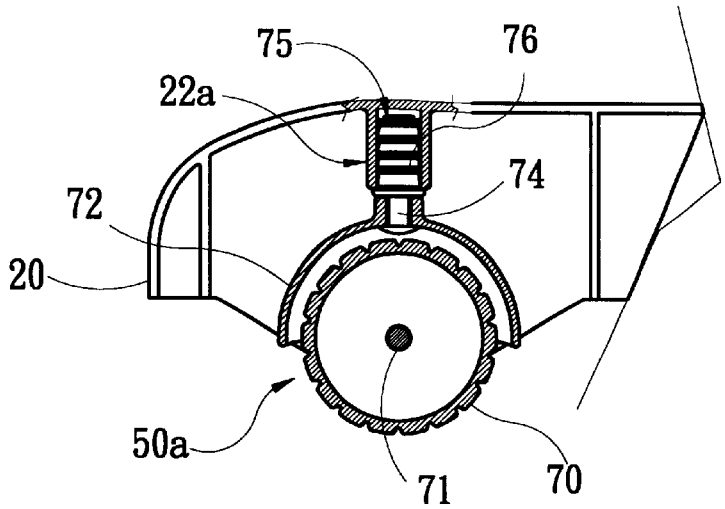
FIG. 4A is a side view of an un-directional roller of the first embodiment of the present invention, the child walker.
Figure 4B:
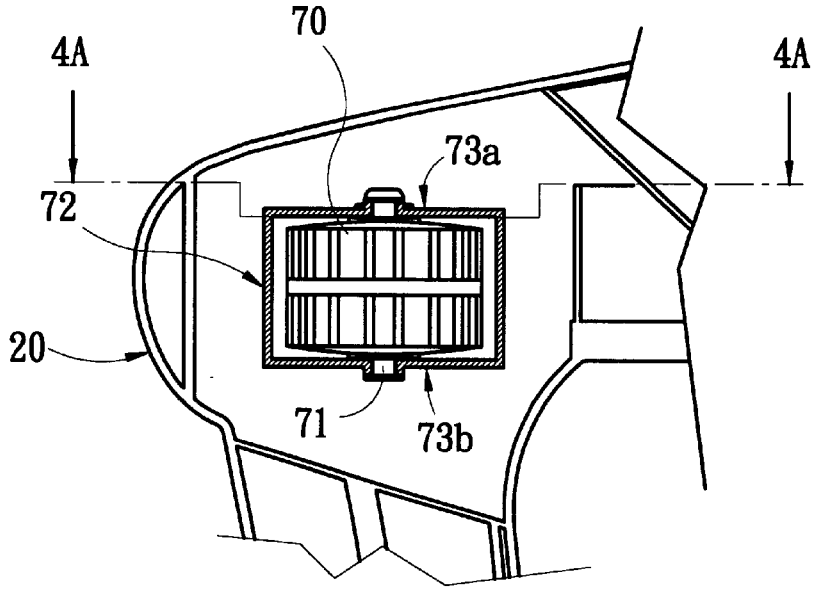
FIG. 4B is a bottom view of an un-directional roller of the first embodiment of the present invention, the child walker.

Referring to FIG. 4A and FIG. 4B, the structures of the un-directional rollers 50*a* and 50*b* are essentially the same, and one of them will be described below. The un-directional roller 50*a* includes a wheel 70 which is connected to a wheel cover 72 by an axis 71. The wheel cover 72 is a hollow shell and essentially comprises two side walls 73*a* and 73*b* in both sides of the axial direction. The axis 71 passes through side walls 73*a* and 73*b* in both ends. The wheel cover 72 is jointed to the circular base member 20 by an axis 74 and can freely turn . The axis 74 is preferred to be loosely jointed in an axis tube 75. The outer surface of the axis tube 75 has a plurality of back teeth 76 been arranged in the axial direction thereof in order to be fitted into the fixed tube 22*a* which is at the bottom of the base member 20. Therefore, the wheel 70 can freely turn around with the supporting of the wheel cover 72 and leads the child walker moving in any direction.

In FIGS. 4A and 4B, the axis 74 is straight and extends in the axial direction and perpendicular to intersect with the axis 71. In another embodiment shown in FIGS. 5A and 5B, the axis 74*a* is composed of two sections, the upper axis 741 and the lower axis 742, which are parallel to each other and connecting portion 743 which connects the upper axis 741 and the lower axis 742. The upper axis 741 is fitted to the axis tube 75, while the lower axis 742 is fitted to the wheel cover 72. This design will make the turning of the un-directional roller 50*a* of the wheel 70 and the moving of the child walker much easier.

The detailed structure of directional rollers 60*a* and 60*b* can be illustrated by the following embodiments.

Figure 6A:
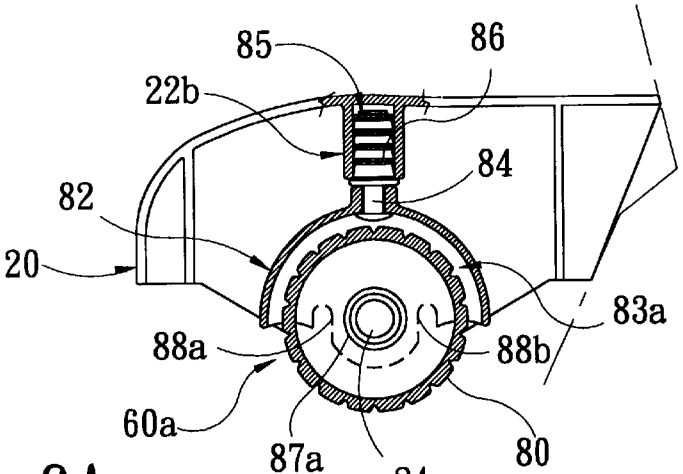
FIG. 6A is a side view of a directional roller of the first embodiment of the present invention, the child walker.
Figure 6B:
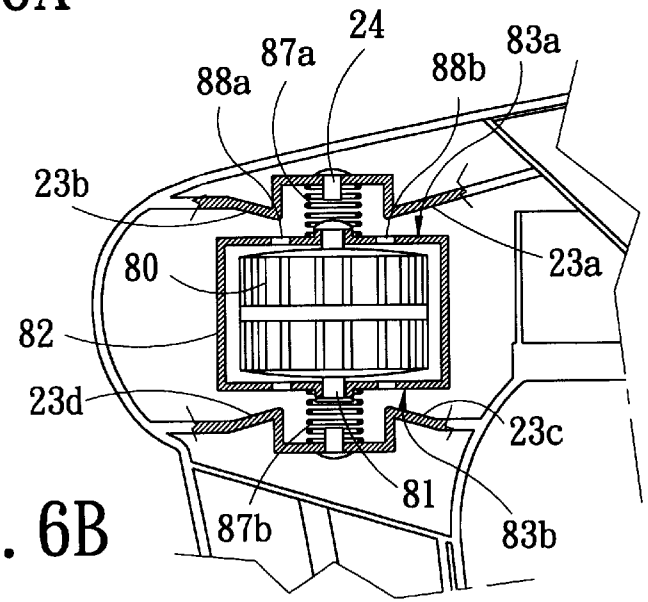
FIG. 6B is a bottom view of FIG. 6A.
Figure 6C:
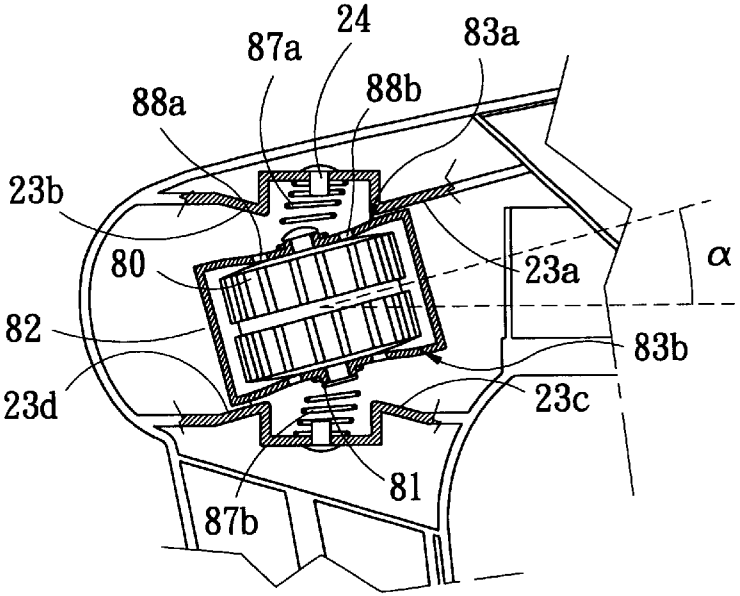
FIG. 6C is a bottom view of FIG. 6A, depicting the operation status of the auto-braking function of the directional roller.

Referring to FIGS. from 6A to FIG. 6C, they are the structure diagrams of the first embodiment of the directional rollers 60*a* and 60*b*. The structures of the directional rollers 60*a* and 60*b* are essentially the same, and one of them will be described below. The structure of the directional roller 60*a* is similar to the un-directional rollers 50*a* and 50*b*. The directional roller 60*a* includes a wheel 80 which is connected to a wheel cover 82 by an. The wheel cover 82 is a hollow shell and essentially comprises two side walls 83*a* and 83*b* in both sides of the axial direction. The axis 81 passes through side walls 83*a* and 83*b* in both ends. The wheel cover 82 is jointed to the circular base member 20 by an axis 84 and can freely turn. The axis 84 is preferred to be loosely jointed in an axis tube 85. The outer surface of the axis tube 85 has a plurality of back teeth 86 been arranged in the axial direction thereof in order to be fitted into the fixed tube 22*b* which is at the bottom of the base member 20. Therefore, the wheel 80 can freely turn around with the supporting of the wheel cover 82 and leads the child walker moving in any direction.

There are four braking surfaces 23*a*, 23*b*, 23*c* and 23*d* at the bottom of the circular base member 20. These braking surfaces 23*a*, 23*b*, 23*c* and 23*d* are extending separately outward from the center of the axis 84 and keep an angle of $\alpha$, which is preferred to be less than 15 degree, with respect to the line of forward direction. These braking surfaces 23*a*, 23*b*, 23*c* and 23*d* must be low enough and are located at both sides of the wheel 80 in order to constrain the wheel cover 82 to the straight line of forward direction within a little deviation in angle from it and keep the child walker moving toward the safe direction when the wheel cover 82 and the circular base member 20 are turning relatively to each other with respect to the center of the axis 84.

Figure 5A:
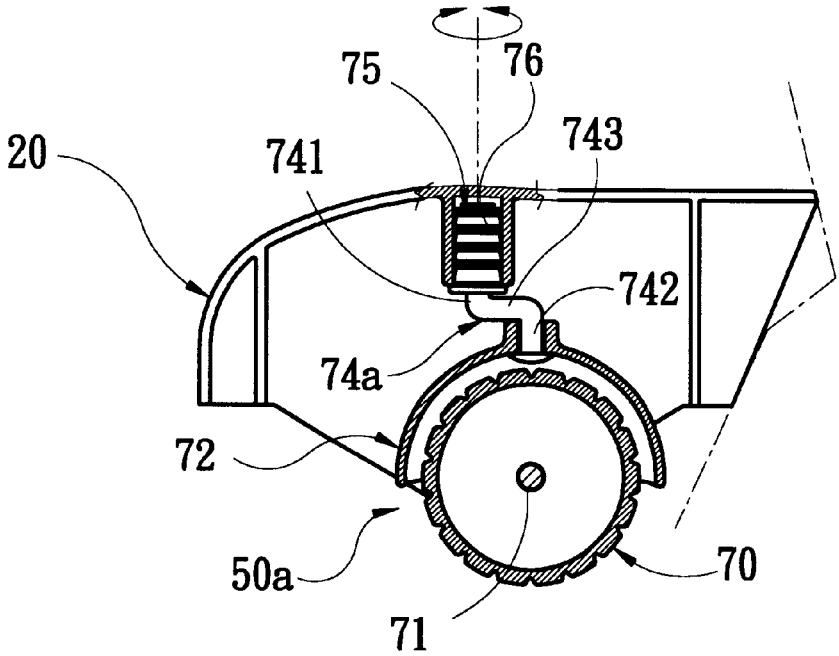
FIG. 5A is a side view of an un-directional roller of the second embodiment of the present invention, the child walker.
Figure 5B:
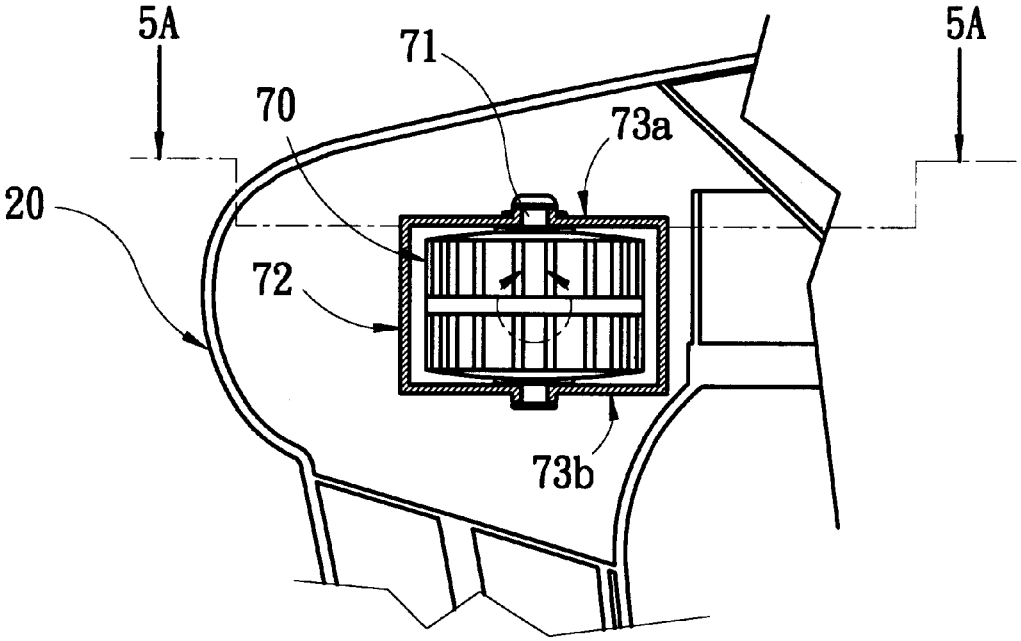
FIG. 5B is a bottom view of an un-directional roller of the second embodiment of the present invention, the child walker.

Side walls 83*a* and 83*b* of the wheel cover 82 are normally keeping a small gap with both sides of the wheel 80. These small gaps are preferred not to affect the free rolling of the wheel 80. On outer sides of side walls 83*a* and 83*b*, especially on both axial ends of axis 81 of the wheel 80, there are respectively springs 87*a* and 87*b*. The springs 87*a* and 87*b* are compressible spiral springs. Each of them is fitted with one axial end of the wheel 80 in one hand and fitted with a outstanding fixing portion 24 of the surface of the circular base member 20 in the other hand. The way to practice the outstanding fixing portion is to install a columnar element, or a rivet connected with the circular base member 20, as shown in FIG. 5A.

The spring 87*a* and 87*b* can keep the wheel 80 turning along the forward direction when the child walker does not encounter any external force. When the child walker encountered external force, such as the lateral pushing, or the force made by the child and are piloted toward the direction which deviates the straight direction to a large extent, that is, it goes toward the unsafe direction, the side walls 83*a* and 83*b* of the wheel cover 82 will be compelled by the springs 87*a* and 87*b* and be lightly deformed to tightly contact both sides of the wheel 80, see FIG. 5C. The friction force between the sides walls 83*a* and 83*b* and the wheel 80 stops the moving of the wheel 80 and provides an auto-braking for the child walker to control the speed of the child walker.

In order to achieve the foregoing function, the side walls 83*a* and 83*b* of the wheel cover 82 must have the ability of deforming and elasticity. This can be met by controlling the thickness of the side walls 83*a* and 83*b* and utilizing the plastic material to make the wheel cover 82. Besides, another method is to form a suitable gap or hole 88*a* and 88*b* in the side walls 83*a* and 83*b*. This method may change the flexibility of the side walls 83*a* and 83*b* and it will be much easier to deform them when they are compelled by springs 87*a* and 87*b*, which consequently tightly passing both axial sides of the wheel.

Figure 7A:
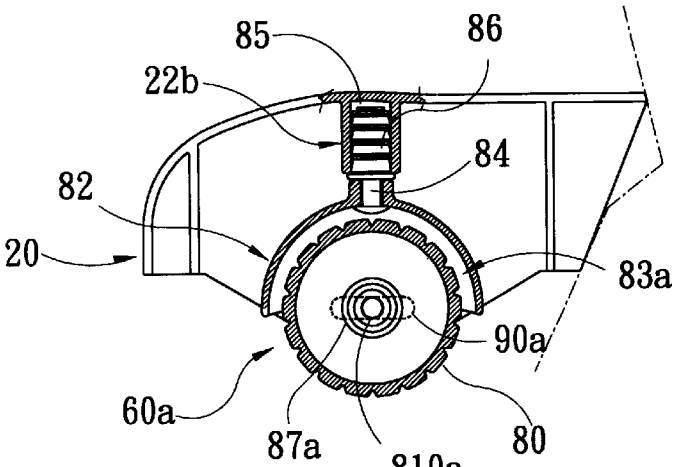
FIG. 7A is a side view of a directional roller of the second embodiment of the present invention, the child walker.
Figure 7B:
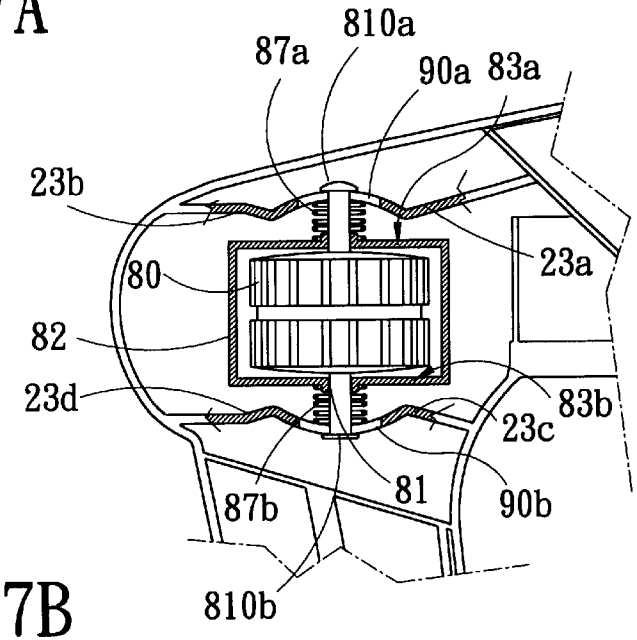
FIG. 7B is a bottom view of FIG. 7A.
Figure 7C:
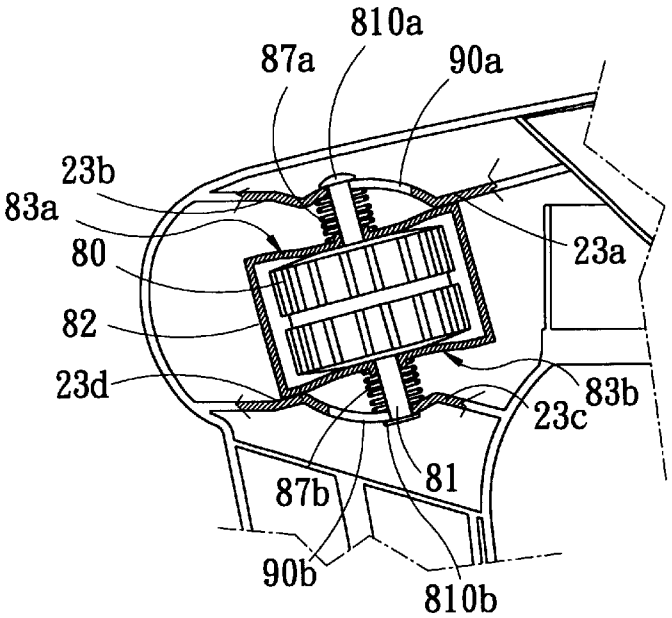
FIG. 7C is a bottom view of FIG. 7A, depicting the operation status of the auto-braking function of the directional roller.

Referring to FIGS. 7A, 7B and 7C, another embodiment of directional roller 60*a* and 60*b* is accomplished in accordance with the first embodiment, shown in FIGS. 6A, 6B and 6C, with some variations. The variations shown in FIGS. 7A, 7B and 7C are described below. The length of the axis 81 increases and changes to a longer axis 81*a*. The axis 81*a* passes through both axial ends, springs 87*a* and 87*b* and wide holes 90*a* and 90*b*. These wide holes 90*a* and 90*b* are respectively located between the braking surfaces 23*a* and 23*b* and between 23*c* and 23*d*. The wide holes 90*a* and 90*b* are the part of circular base member 20, extends by centering around the axis 84 in an arc way 97 with changeable diameter; the more it is close to the ends with respect to the longer axis of the wide holes 90*a* and 90*b*, the more the diameter as mentioned above will reduce in comparison with that in the center of the wide holes 90*a* and 90*b*. Both axial ends of axis 81*a* have mushroom heads 810*a* and 810*b* which are larger in diameter than that of wide holes 90*a* and 90*b* in any portion to prevent the axis 81*a* from taking off.

The springs 87*a* and 87*b* will be respectively constrained in between wide holes 90*a* and 90*b* and side walls 83*a* and 83*b* under the limitation of wide holes 90*a* and 90*b* and side walls 83*a* and 83*b*. FIG. 7A shows the normal status thereof.

As described in the first embodiment, once the child walker deviates the safe direction, the side walls 83*a* and 83*b* of the wheel cover 82 will be compelled by the springs 87*a* and 87*b* and be lightly deformed to tightly contact both sides of the wheel 80, see FIG. 7C. The friction force between the sides walls 83*a* and 83*b* and the wheel 80 stops moving of the wheel 80 and provides a auto-braking for the child walker to control the speed of the child walker. The springs 87*a* and 87*b* change their length while axis 81*a* is rolling. The recovery force of the springs 87*a* and 87*b* changes while the length of them changes and turns the wheel 80 rolling toward the forward direction.

Figure 8A:
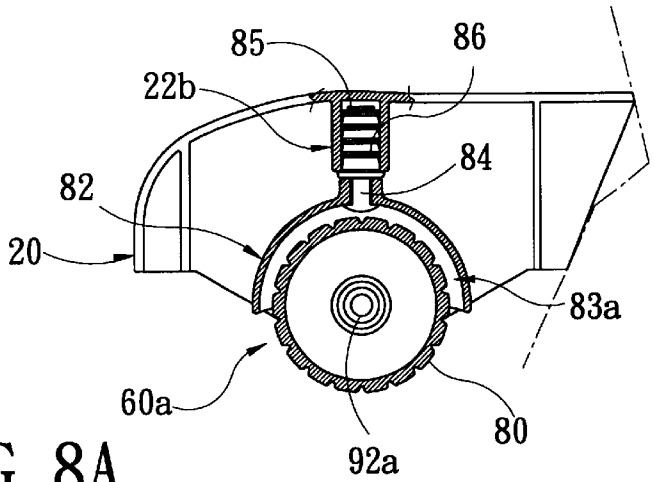
FIG. 8A is a side view of a directional roller of the third embodiment of the present invention, the child walker.
Figure 8B:
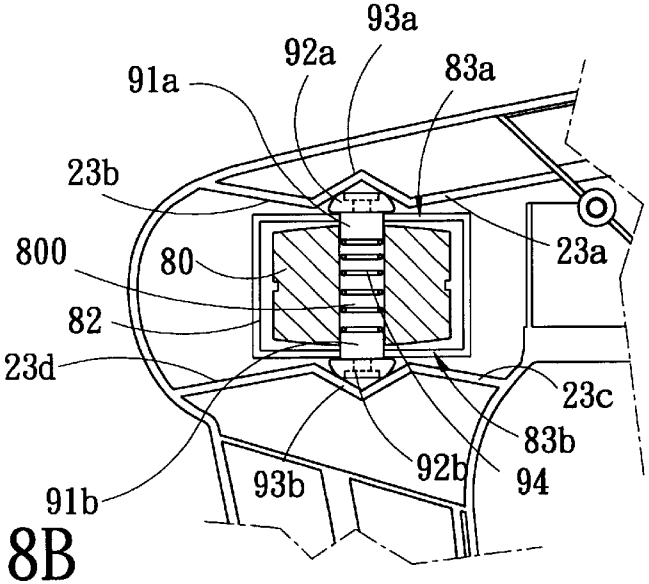
FIG. 8B is a bottom view of FIG. 8A.
Figure 8C:
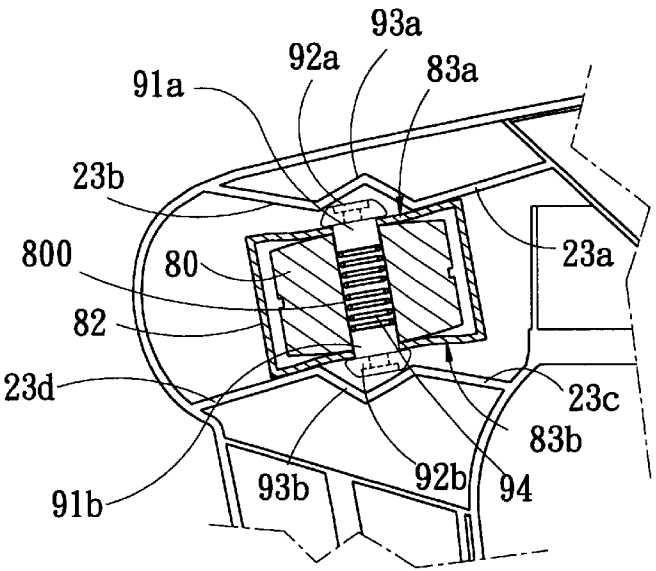
FIG. 8C is a bottom view of FIG. 8A, depicting the operation status of the auto-braking function of the directional roller.

Referring to FIGS. 8A, 8B and 8C, another embodiment of directional roller 60*a* and 60*b* is accomplished in accordance with the first embodiment, shown in FIGS. 6A, 6B and 6C, with some variations. In this embodiment, the axis is divided into a left axis 91*a* and a right axis 91*b*, which are apart but in the same axial line. These axes 91*a* and 91*b* are respectively fitted into the hole 800 and can slide in the hole 800. The outer portion of the axes 91*a* and 91*b* extending from the wheel 80 have respectively mushroom heads 92*a* and 92*b* in their ends. There are concave portions 93*a* and 93*b* at the contact portion of the circular base member 20 to receive mushroom heads 92*a* and 92*b*. These concave portions 93*a* and 93*b* are located between braking surfaces 23*a* and 23*b* and 23*c* and 23*d*, and include two inclined plane 931 and 932 just to hold foregoing mushroom heads 92*a* and 92*b* separately. A spring 94 is located between left axis 91*a* and right axis 91*b* and pushes the left axis 91*a* and the right axis 91*b* outward in the axial direction of the wheel 80. Accordingly, mushroom heads 92*a* and 92*b* are normally kept in the middle of concave portions 93*a* and 93*b* for keeping the wheel 80 rolling toward the forward direction.

Referring to FIG. 8C, once the child walker deviates the safe direction, the side walls 83*a* and 83*b* of the wheel cover 82 will be compelled by the springs 87*a* and 87*b* and be lightly deformed to tightly contact both sides of the wheel 80. The friction force between the sides walls 83*a* and 83*b* and the wheel 80 stops the moving of the wheel 80 and provides an auto-braking for the child walker to control the speed of the child walker.

Figure 9A:
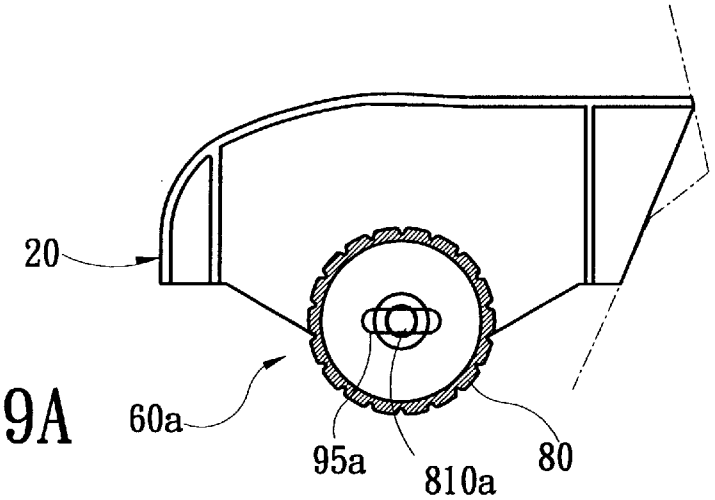
FIG. 9A is a side view of a directional roller of the fourth embodiment of the present invention, the child walker.
Figure 9B:
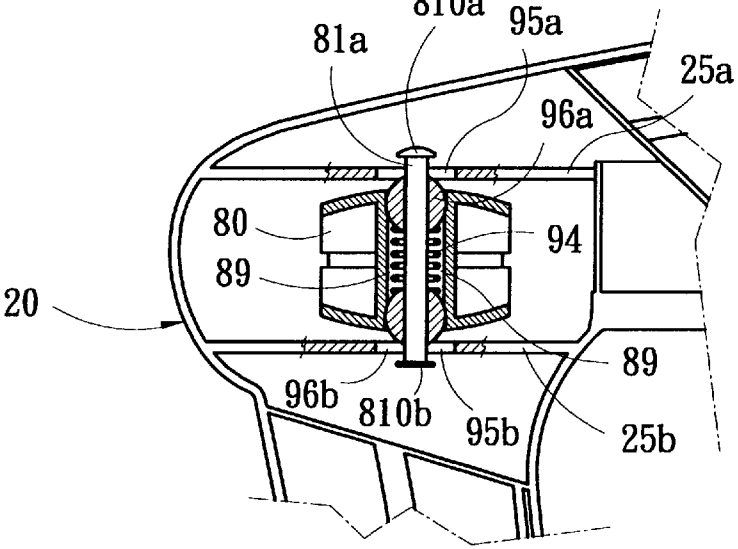
FIG. 9B is a bottom view of FIG. 9A.
Figure 9C:
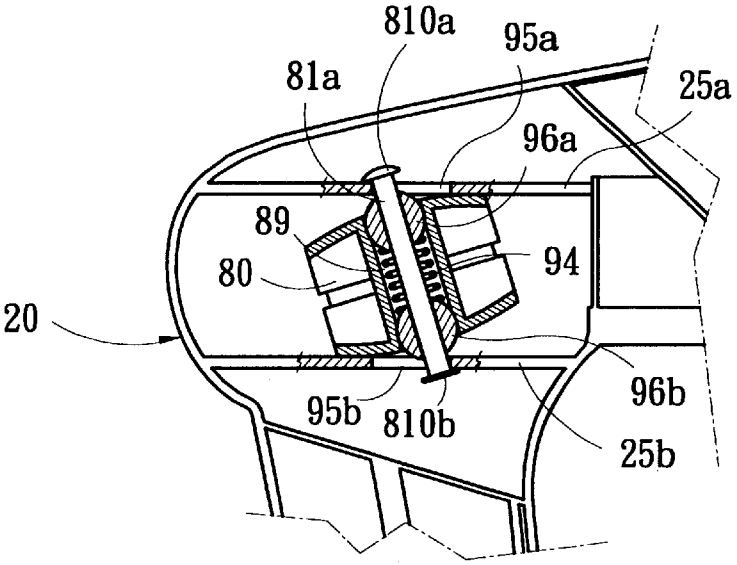
FIG. 9C is a bottom view of FIG. 9A, depicting the operation status of the auto-braking function of the directional roller.

Referring to FIGS. 9A, 9B and 9C,another embodiment of directional rollers 60*a* and 60*b* is accomplished in accordance with the first embodiment, shown in FIGS. 6A, 6B and 6C, with some variations. In this embodiment, the directional rollers 60*a* and 60*b* do not have the wheel cover 82. The wheel 80 is supported by the axis 81 a which passes through a hole 89 of the wheel 80. Both axial ends of the axis 81 a respectively having mushroom heads 810*a* and 810*b* straightly pass through wide holes 95*a* and 95*b* and are larger in diameter than the wide holes 95*a* and 95*b* to prevent the axis 81*a* from taking off. These wide holes 95*a* and 95*b* are parallel to each other and located at the braking surface 25*a* and 25*b*, which are also parallel to each other, of the circular base member 20. Besides, the axis 81*a* passes through two ball bearings 96*a* and 96*b* and a spring 94 which is located between the ball bearing 96*a* and ball bearing 96*b*. The diameter of axis 81*a* is smaller than the inner diameter of the hole 89. The diameters of ball bearings 96*a* and 96*b* are all a little larger than the inner diameter of the hole 89. Normally, the force from the spring 94 pushes the ball bearings 96*a* and 96*b* outward to contact braking surface 25*a* and 25*b* in order to keep the wheel 80 moving toward the forward direction.

Essentially the same, referring to FIG. 9C, once the child walker deviates the safe direction, the side walls 83*a* and 83*b* of the wheel cover 82 will be compelled by the springs 87*a* and 87*b* and be lightly deformed to tightly contact both sides of the wheel 80. The friction force between the sides walls 83*a* and 83*b* and the wheel 80 stops the moving of the wheel 80 and provides an auto-braking for the child walker to control the speed of the child walker. The spring 94 also makes the wheel 80 moving toward the forward direction when the child walker recovers itself to the forward direction.

What is claimed is:

1. A chile walker, comprising:

a seat for supporting a child body, a supporting structure connected to a circular base member for supporting said seat, and a circular base having a base, front corners and rear corners, a moving device connected to the bottom of said circular base member for supporting said circular base member, wherein the moving device further comprises:

first and second un-directional rollers respectively connected to the front corners of said circular base member for moving in any direction, and first and second directional rollers respectively connected to the rear corners of said circular base member, each of said first and second direction rollers includes a wheel, a plurality of braking surfaces attached to the bottom of said circular base member, said braking surfaces being arranged on both axial side surfaces of said wheel such that said wheel can only move within a small angle along a moving direction, and an auto braking device which includes an elastic stopping means and a wheel cover to brake the wheel upon engagement with the braking surface when the roller and the wheel cover have pivoted beyond a predetermined angle.

2. A child walker as described in claim 1, wherein said un-directional roller includes a wheel which can turn to any direction.

3. A child walker as described in claim 1, where in said directional roller is composed of a wheel cover having two sides connected to said circular base member by a vertical axis and a wheel connected to said wheel cover by passing an axis through said side walls thereof, wherein said wheel cover can freely turn around said vertical axis in a narrow angle, wherein said walls of said wheel contact the friction surface of said circular base member and limit the forward direction of said wheel when it is caused to turn in an angle ider than the narrow angle.

4. A child walker as described in claim 3, wherein said wheel cover further comprises an auto-braking device for controlling the rolling speed of said wheel and keeping said moving direction of said child walker.

5. A child walker as described in claim 4, wherein said auto-braking device comprises two springs located at both axial sides of said wheel and connected to said wheel cover at one end and said circular base member at another end for compelling said wall sides and said wheel cover to slow down and lead to the forward direction when the moving direction of said wheel deviates a wide angle.

6. A child walker as described in claim 1, wherein a plurality of friction strips is attached to the bottom of said circular base member.

7. A child walker as described in claim 6, wherein said friction strip is a rubber strip.

8. A child walker as described in claim 6, wherein the surface of said strip has zigzag thereon.

* * * * *